United States Patent [19]

Vásquez

[11] 4,117,468

[45] Sep. 26, 1978

[54] SOUND ALARM FOR PROTECTING BRIEFCASES AND THE LIKE

[76] Inventor: Tulio Vásquez, Carrera 43-A, No. 30-91, Medellín, Colombia

[21] Appl. No.: 777,935

[22] Filed: Mar. 15, 1977

[51] Int. Cl.[2] ..... G08B 13/14

[52] U.S. Cl. ..... 340/571

[58] Field of Search ..... 340/63, 65, 280, 282, 340/283, 261

[56] References Cited

U.S. PATENT DOCUMENTS 2,758,296 8/1956 Larsen ..... 340/280

*Primary Examiner*—Alvin H. Waring

*Attorney, Agent, or Firm*—Browdy and Neimark

[57] ABSTRACT

A sonorous alarm system to be placed in briefcases and small valises will permit the person who uses the same to have an opportune warning in the case that someone non-authorized tries to carry with him the small valise when the proprietary has it on the floor. Additionally, the alarm can also be generated when someone non-authorized tries to carry with him the small case by sliding it on the floor. As a complement, the system can be provided with alarm generating means operated when the small case is opened. The sonorous alarm will be generated in each of the foregoing cases and will be heard at several meters in the surrounding space. The proprietary is able to energize the alarm generating means by pushing one (or several) exterior push-buttons.

11 Claims, 4 Drawing Figures

SOUND ALARM FOR PROTECTING BRIEFCASES AND THE LIKE

FIELD OF THE INVENTION

The present invention broadly relates to electric alarms for protection against theft of small cases, hand valises and related objects.

BACKGROUND OF THE INVENTION

Protection against theft of small cases is usually obtained by mean of an internally located alarm device controlled by a key, a system which produces an alarm when the small case is non-authorizedly opened.

In other cases, the protection against theft of the small case is made by means of a chain with one of its ends attached to the small case, activating a contact which triggers the alarm when the small case is carried off, because the other end of the chain is fastened to a bracelet in the wrist of the proprietary. In this case, there is an evident uncomfortableness and dependence for the proprietary because he must be permanently attached to the small case.

The present invention contemplates a protection system against theft of the small case by means of a simple electrical circuit and the addition thereto of lifting and/or sliding sensing switchs, its operation being very simple, because it is only required to push one or two push-buttons, depending on the degree of security desired, thus permitting the proprietary not to be dependent on the small case when he leaves it on the floor, and a sound alarm being produced when the small case is lifted, slided on the floor, or opened.

SUMMARY OF THE INVENTION

The present invention consists in a sonorous alarm system to be placed in valises and small cases, which will permit the owner to have an opportune warning in case that someone non-authorized tries to carry away the small case with him when the proprietary has placed it on the floor. The foregoing is achieved in a practical and simple way permitting the owner to be quiet when he temporarily leaves the small case on the floor, because he will hear an alarm in the surrounding space when the small case is intervened by someone non-authorized.

The present system has the characteristic of producing a sound during several seconds, which can be heard several meters away when the small case is lifted, after an electrical device has been activated by pushing a push-button placed in its exterior. This sound will also be produced when the owner lifts the small case, a sonorous warning being produced in any case when someone non-authorized tries to carry the small case with him in a moment of distraction of the proprietary.

Complementarily, the system can be provided with a second push-button, which, being pushed, will activate another part of this electrical device, which in turn will produce the same sound when the small case is opened; this feature will be very useful for the proprietary since he will be warned in the case that someone non-authorized opens the small case, which system is not controlled by a key.

Still complementarily, the small case can be provided with a specially designed contactor, which activates the electrical device in the case that, instead of being lifted, the small case is slid on the floor.

DESCRIPTION OF THE DRAWINGS

To additionally facilitate the understanding of the present invention, reference is made to the accompanying drawing, wherein.

DESCRIPTION OF THE PREFERRED EMBODIMENT

Figure 1:
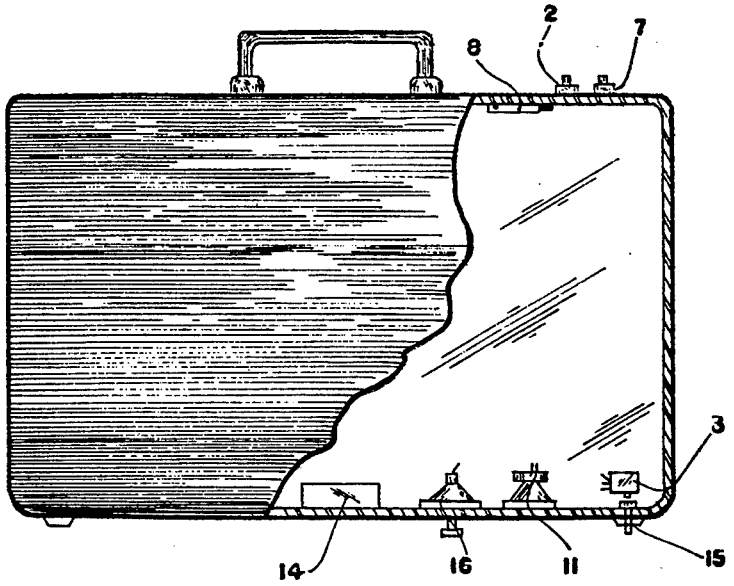
FIG. 1 is an elevation view of the small case, showing a possible localization of the necessary push-buttons, switches and electric circuit.
Figure 3:
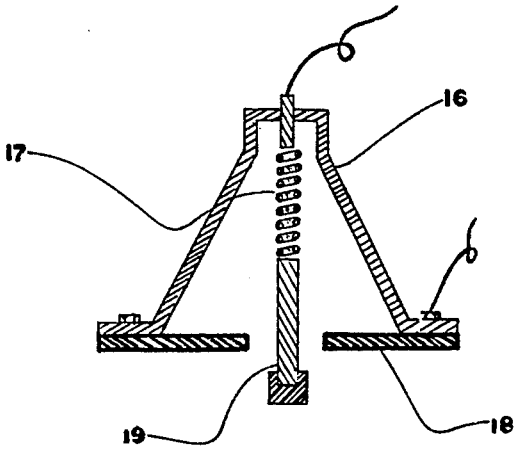
FIG. 3 is a side, sectional view of the special switch used to activate the alarm when the small case is slid on the floor.
Figure 4:
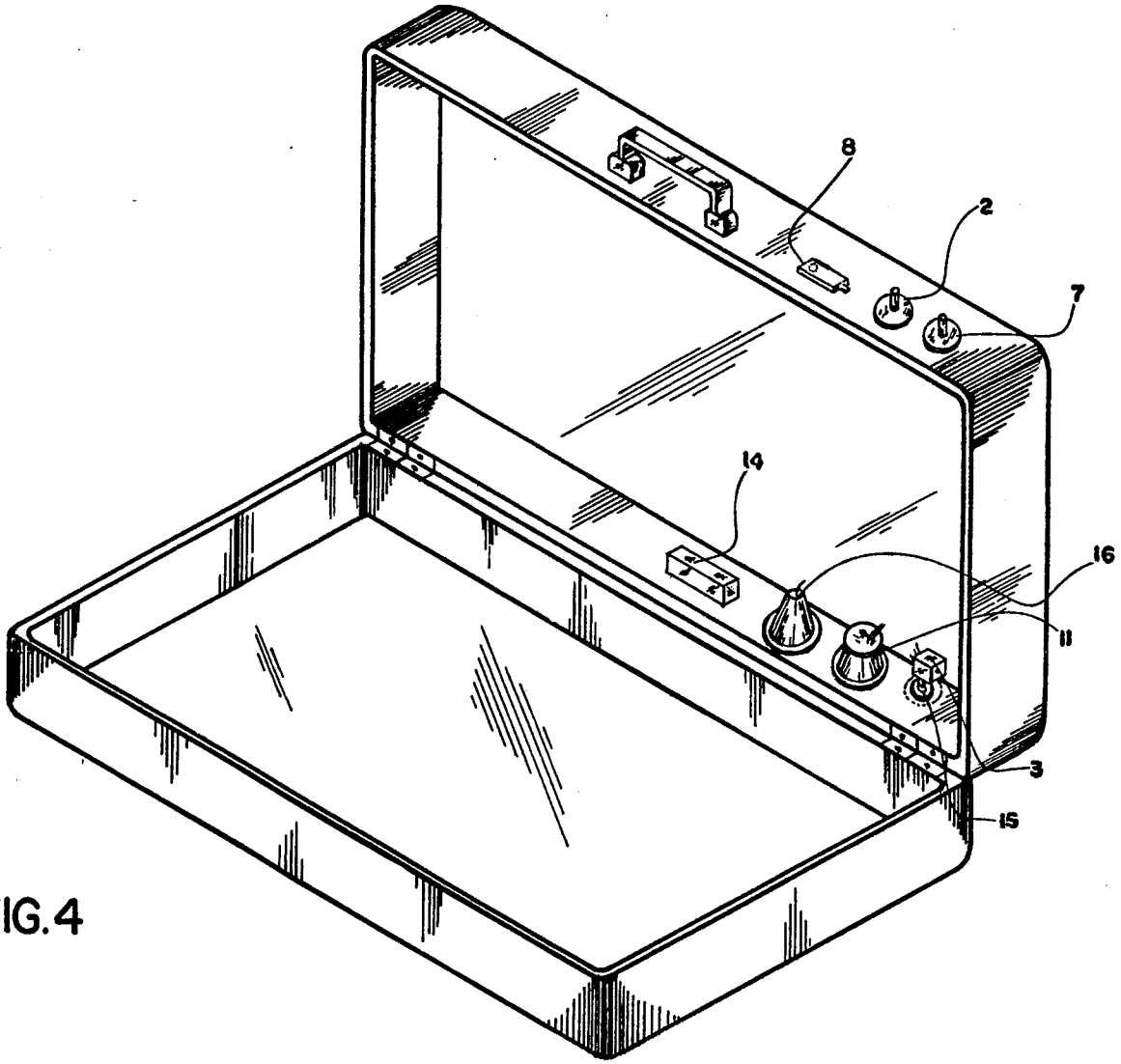
FIG. 4 is a perspective view showing a possible arrangement of circuit elements relative to a briefcase.

The small case of FIG. 1 has been provided with a push-button 2 which, when it is pushed and the small case is on the floor, activates an electrical device which will be described hereinafter. After having acted on the push-button 2, a short alarm will be produced by means of the loudspeaker 11, when the small case is lifted, due to the action of the pulsator 15, which liberates the microswitch 3. In a similar manner, an alarm will be produced if, instead of being lifted, the small case is slid on the floor, due to the action of the special sliding sensor 16 (FIG. 3), which closes the circuit between the contact cylinder 19 (its buttom end being made of rubber), and the ring-contact 18. The spring 17 has an expansive and centering effect for the cylinder 19.

In case the push-button 7, is pushed, an electrical device to be described hereinafter is activated, so that, when the small case is opened, the microswitch 8 is liberated, producing an alarm by means of the loudspeaker 11 for several seconds.

The electrical components which complement the electrical circuit, such as the battery, condensers and other components are placed in the compartment 14.

Figure 2:
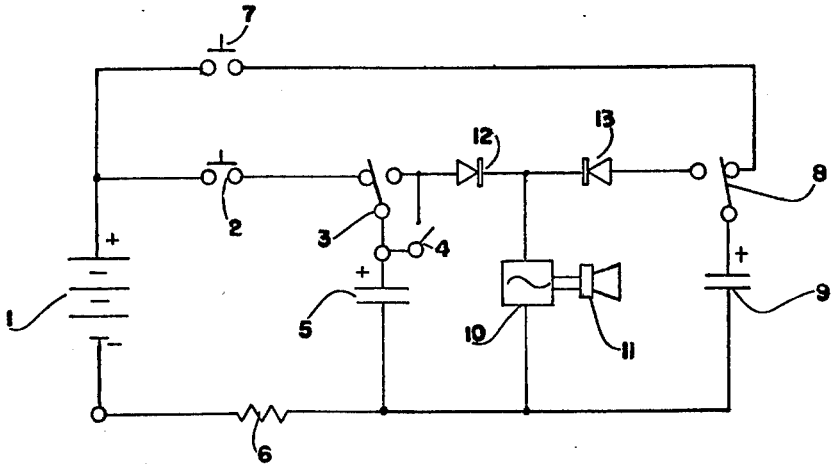
FIG. 2 is a diagrammatic view of the necessary electric circuit in which the alarm device is electrically connected.

Referring to FIG. 2, that is, the electric circuit, the power source is the battery 1; the microswitch 3 SPDT will be in its transferred position, closing its contact N/o when the small case is on the floor, so that for the condenser 5 to be charged it is only necessary for the proprietary to close the contact of the push-button 2 N/o. When this happens, by manual action, the condenser 5 will be charged to the battery voltage through the resistance element 6. The condenser 5, having no leakage resistance, will maintain its charge during several days. When the small case is lifted, the microswitch 3 will be transferred to it N/C position, permiting the charge of the condenser 5 to be applied to the oscillator 10, which, upon oscillating, will activate the loudspeaker 11 during several seconds, depending on the capacity of the condenser 5. If the small case, instead of being lifted, is slid on the floor, the special contactor 16 closes its contacts N/o 4, activating the loudspeaker 11 in a manner similar to that explained for the microswitch 3. There is provided a circuit for the condenser 9 similar to that of the condenser 5; when the push-button 7 N/o is pushed, the condenser 9 will proceed to charge. When the small case is opened, the microswitch 8 SPDT will be transferred to its N/C position, activating thus the loudspeaker 11. Diodes 12 and 13 are located as shown to permit the oscillator 10 to be activated by the microswitches 3 and 8, or the contact 4, as the case may be, avoiding interaction between the two circuits, in the sense, as an example, that when the microswitch 3 transfers the energy of the condenser 5, this energy is applied totally to the oscillator 10, and not to the condenser 9, in case that this condenser is discharged.

What is claimed is:

1. An alarm system for use in a small case or hand valise, comprising:

a first electric circuit, including, connected in series, a power source, and
a condenser;

a switch, located on the exterior of the case or valise, for opening said first circuit when in a first position and for closing said first circuit when in a second position, thereby permitting said power source to energize said condenser when in the second position;

a second electric circuit, connected in series, comprising
said condenser, and
an electric sonorous element for emitting a sound alarm when activated by energy accumulated in said condenser;

a single pole double throw switch for closing said first circuit and opening said second circuit when in a first position and for opening said first circuit and closing said second circuit when in a second position, thereby permitting any energy stored in said condenser to activate said electric sonorous element when in the second position; and switch changing means for causing said single pole double throw switch to be in the first position thereof when the base of the case or valise is placed on a surface and for causing said single pole double throw switch to switch to the second position thereof when the case or valise is lifted from the surface.

2. An alarm system in accordance with claim 1, further including:

second switch means for causing the activation of said electric sonorous element when the base of the case or valise is slid along the surface.

3. An alarm system in accordance with claim 2, wherein said second switch means includes:

a central contact extending from the base of the case or valise;

an expansion spring, connected to said central contact for causing said central contact to exert pressure upon the surface when the base of the case or valise is resting on a surface; and a contact ring surrounding said central contact, said central contact and said contact ring closing a circuit causing activation of said electric sonorous element when the case or valise is slid along the surface, thereby causing said contacts to contact one another.

4. An alarm system in accordance with claim 1, wherein said switch changing means comprises:

a sensing pin extending from the base of the case or valise and exerting pressure on the surface when the base of the case or valise is in contact with a surface, said sensing pin being connected to said single pole double throw switch such that said switch is in said first position when said sensing pin is depressed by the surface and said switch is in said second position when said sensing pin is liberated upon lifting of the case or valise.

5. An alarm system in accordance with claim 1, wherein said switch is a push-button switch.

6. An alarm system in accordance with claim 1, further including a third electric circuit including, connected in series, a power source, and
a second condenser;

a second switch, located on the exterior of the case or valise, for opening said third circuit when in a first position and for closing said third circuit when in a second position, thereby permitting said power source to energize said second condenser when in the second position;

a fourth electric circuit, connected in series, comprising
said second condenser, and
an electric sonorous element for emitting a sound alarm when activated by energy accumulated in said second condenser;

a second single pole double throw switch for closing said third circuit and opening said fourth circuit when in a first position and for opening said third circuit and closing said fourth circuit when in a second position, thereby permitting any energy stored in said second condenser to activate said electric sonorous element when in the second position; and second switch changing means for causing said second single pole double throw switch to be in the first position thereof when the case or valise is closed and for switching said second single pole double throw switch to the second position thereof when the case or valise is opened.

7. An alarm system in accordance with claim 6, wherein the power source of said first electric circuit and the power source of said third electric circuit are the same power source.

8. An alarm system in accordance with claim 6, wherein the electric sonorous element of said second electric circuit and the electric sonorous element of said fourth electric circuit are the same electric sonorous element.

9. An alarm system in accordance with claim 1 wherein said second switch is a push-button switch.

10. An alarm system for use in a small case or hand valise, comprising:

a first electric circuit, including, connected in series, a power source, and
a condenser;

a switch, located on the exterior of the case or valise, for opening said first circuit when in a first position and for closing said first circuit when in a second position, thereby permitting said power source to energize said condenser when in the second position;

a second electric circuit, connected in series comprising
said condenser, and
an electric sonorous element for emitting a sound alarm when activated by energy accumulated in said condenser;

a single pole double throw switch for closing said first circuit and opening said second circuit when in a first position and for opening said first circuit and closing said second circuit when in a second position, thereby permitting any energy stored in said condenser to activate said electric sonorous element when in the second position; and switch changing means for causing said single pole double throw switch to be in the first position thereof when the case or valise is closed and for causing said single pole double throw switch to switch to the second position thereof when the case or valise is opened.

11. An alarm system in accordance with claim 10, wherein said switch is a push-button switch.

* * * * *